US005675860A

United States Patent [19]

Campbell

[11] Patent Number: 5,675,860

[45] Date of Patent: Oct. 14, 1997

[54] HAND-HELD APPLICATOR TOOL

[75] Inventor: Carl Campbell, Morrison, Colo.

[73] Assignees: Timothy J. Martin; Michael R. Henson, both of Lakewood, Colo.

[21] Appl. No.: 626,045

[22] Filed: Apr. 1, 1996

[51] Int. Cl.[6] ..... B05C 17/10

[52] U.S. Cl. ..... 15/235.7; 425/458; D8/45

[58] Field of Search ..... 15/235.3, 235.7, 15/245.1; 425/458; D8/45

[56] References Cited

U.S. PATENT DOCUMENTS

| | | | |
|---|---|---|---|
| D. 332,901 | 2/1993 | Campbell | D8/45 |
| 1,703,785 | 2/1929 | Shuttleworth | 425/458 |
| 2,247,603 | 7/1941 | Christman | 425/458 |
| 2,247,604 | 7/1941 | Christman | 425/458 |
| 3,761,992 | 10/1973 | Schneller | 15/235.7 X |
| 3,878,581 | 4/1975 | Perna | 15/235.7 |
| 4,211,501 | 7/1980 | Pedroso et al. | 15/235.7 X |
| 5,440,776 | 8/1995 | Kartler | 15/235.7 |

OTHER PUBLICATIONS

"Perfect Bead" Caulk Finishing Tool, by Myro, Inc., Milwaukee, Wisconsin.

*Primary Examiner*—Mark Spisich

*Attorney, Agent, or Firm*—Timothy J. Martin; Michael R. Henson

[57] ABSTRACT

A hand held applicator tool adapted to work a mass of filler material into a gap to form a seal between two pieces. The tool includes a handle having attached thereto a tapered head defined by tapered lateral side edges thereof which cooperate to define a tip as well as a working surface. The head being upturned in the area adjacent the tip and including a rim margin adjacent the side edges and the tip wherein the rim margin is made of a flexible and resilient material. The tool may further have working tips each having a different radius of curvature so as to seal a gap having at least two different bead widths.

20 Claims, 2 Drawing Sheets

HAND-HELD APPLICATOR TOOL

FIELD OF INVENTION

The present invention broadly concerns applicator tools that are adapted to work a mass of filler material. More particularly, the present invention is directed to hand-held applicator tools that are adapted to work a mass of filler material into a gap to form a seal between two pieces. Even more specifically, the present invention is directed to hand-held caulking tools for use in sealing a gap between two structural members with a plurality of bead widths of caulking material.

BACKGROUND OF THE INVENTION

Since the earliest known times, man has crafted and employed tools for a variety of purposes to assist in the completion of laborious work. Tools existing today are as diversified in their application as they are in design. The instrumentalities of man's creation range from hand-held tools for assisting the work of mechanics and laborers to complicated assemblages of parts adapted to perform or facilitate mechanical operations.

The construction industry has particular use for a wide variety of tools. The demands of this industry require workers to perform tasks in an efficient manner without sacrificing the quality of workmanship. Much of the work involved in building a structure requires delicacy, accuracy and precision in an effort to make the environment both structurally sound and aesthetically pleasing. The need to provide a sealant, such as a caulking compound or other equivalent filler material, is prevalent in many structures where joints are formed between two surfaces, such as around windows, doors, bathroom tiling and the like. Sealants are particularly necessary at these juncture locations to provide a water tight and weather proof seal against the infiltration of air and moisture. This helps to conserve energy and reduce the risk of damage to surrounding areas.

In the past, hand-held implements have been developed in an effort to facilitate the application of caulking compounds into the joints between surfaces. There has also been an apparent attempt to construct these implements so that an aesthetically pleasing, yet durable bead of caulking material is applied to the joint.

One such product, marketed by H.E.M.A. Enterprises under the name "The Original Caulking Tool" and subject of U.S. Pat. No. Des. 332,901, issued Feb. 2, 1993 to the present inventor, is a uniquely designed caulking tool formed as a unitary plastic construction. The caulking tool generally comprises an elongated handle portion and a triangularly configured head portion connected to the handle portion.

The elongated handle portion has a longitudinal axis and the concave head portion is oriented at an angle with respect to this longitudinal axis. The concavity of the head portion is a smooth, uninterrupted working surface that includes a pair of side edges which converge forwardly of the elongated handle to terminate at a curved distal end. Proximal ends of the side edges are connected to the elongated handle by arcuately configured and divergent shoulder edges. The head portion continuously tapers in thickness from its proximal end connection to the elongated handle towards the side edges and the curved distal end. The handle portion is an elongated member having an upper and lower surface and a pair of rearwardly converging sidewalls so that the handle portion has its greatest transverse width proximate to the head portion. A flat, octagonal shaped appendage is disposed at the rearward end of the elongated handle.

U.S. Pat. No. 5,301,843 to Groene, issued Apr. 12, 1994, relates to a combination caulking tube cap and applicator device which generally comprises a tubular cap adapted to engage the nozzle of a caulking container and a spreader blade which is formed integrally with the tubular cap for spreading the material dispensed through the container's nozzle. The tubular cap is sold in conjunction with the caulking container. The body of the cap body engages the container's nozzle by a cylindrical inner sleeve formed therein which is in a spaced relation to the cap body and connected thereto by a radial webbing structure. The spreader blade is connected to the open end of the tubular cap body and is constructed identically to the head portion shown in U.S. Pat. Des. No. 332,901.

In its application, the caulking material is applied to a joint through the use of the provided caulking container or other appropriate applicator. The user then grasps the tubular cap and places the spreader blade over the joint so that the blade's working surface is placed in contact with the caulking material and spans the gap between the two surfaces. Pressure is then exerted on the head portion and the spreader blade is manipulated in a downward direction to form the caulking material into a smooth bead.

While the device which is the subject matter of U.S. Pat. No. 5,301,843 is functional in its own respect, it does have some disadvantages. For example, the tool only allows a user to seam a joint with a single bead width of filler material. Moreover, the tool is cumbersome to manipulate during application because the handle has an awkward configuration. Accordingly, there remains need to provide a new and useful applicator tool which is more versatile in its application and which has a more user friendly construction. The present invention is particularly concerned with meeting these needs, among others.

SUMMARY OF INVENTION

It is an object of the present invention to provide a new and useful applicator tool of improved construction which can be used to work a mass of filler material into a gap between two pieces.

Another object of the present invention is to provide a hand-held applicator tool which may be grasped by a user and easily manipulated to work a mass of filler material into a gap between two pieces.

A further object of the present invention is to provide an inexpensive, hand-held applicator tool which is constructed as an integral piece of molded plastic.

Yet a further object of the present invention is to provide an applicator tool which is adapted to work filler material into a gap between two pieces to form a seal having one of a variety of professionally finished appearances.

The present invention accomplishes the above objects by providing a hand-held applicator tool that is adapted to work a mass of filler material into a gap to form a seal between two pieces. In its broadest form, the hand-held applicator tool according to the present invention comprises a handle that is adapted to be held by a user and a tapered head which is connected to and extends forwardly of the handle. The applicator tool may be molded as an integral, one-piece construction of plastic material, preferably a composite of high and low density polyethylene.

The tapered head has first pair of lateral side edges which converge in a forward direction to define a first tip for the tapered head. A first working surface extends between these lateral side edges and this working surface has an upturned tip area that is located proximate to the first tip. The tapered head further includes a first rim margin which is adjacent to both the first pair of lateral side edges and the first tip, with the first rim margin being formed of a flexible and resilient material to allow it to flex when the user grasps the handle and manipulates the tapered head, thereby working the mass of filler material into the gap to form the seal.

The tapered head may be enlarged proximate to the handle in a direction transverse to the handle's longitudinal axis so that the applicator tool resembles the shape of an arrow. It is preferred that the tapered head be connected to the handle by a pair of shoulders which diverge forwardly of the handle to intersect, respectively, at the first pair of lateral side edges. It is also preferred that both the lateral side edges and the shoulders are symmetrical about the longitudinal axis of the handle and that the shoulders are arcuately configured to accommodate increased flexing of the first rim margin during use.

The tip of the tapered head is preferably curved and has a selected radius of curvature. The first working surface can also include an elevated region which is located proximate to the handle. Further, a portion of the working surface that is located immediately adjacent to the tip is preferably flattened and sloped downwardly in the forward direction relative to the upturned tip area of the tool.

The tapered head of the hand-held applicator tool according to the present invention preferably includes a second pair of lateral side edges which converge in a forward direction to define a second tip for the tapered head. The tapered head thus has a second working surface which extends between this second pair of lateral side edges, with this second working surface preferably being ramped in an area located proximate to its respective tip. A second rim margin, located adjacent to both the second pair of lateral side edges and the second tip, is formed of a flexible, resilient material so that when the user grasps the handle and manipulates the tapered head, thereby acting on the mass of filler material with a selected one of the first and second working surfaces, an associated one of the rim margins flexes so that the filler material is worked into the gap to form the seal.

Here, the first working surface preferably defines an upper surface of the tapered head and the second working surface defines a lower surface of the tapered head. As before, the tips of the tapered head are curved so that the first tip has a first radius of curvature and the second tip has a second radius of curvature which is different than the first radius of curvature so that the applicator tool may be manipulated to seal between the two pieces with different bead widths of the filler material.

A sidewall extends between the first and second pairs of lateral side edges. With the provision of two working surfaces, it is again preferred that an elevated region, as discussed above, be located on each of these working surfaces and that the first and second lateral side edges and the shoulders are symmetrical about the longitudinal axis.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENT

The present invention is directed to a hand-held applicator tool that is particularly adapted to work a mass of filler material into a gap to form a seal between two pieces. Preferably, this applicator tool is formed as a single, integrally molded piece of plastic material by any conventional molding process, such as injection molding. To this end, it has been found that the applicator tool of the present invention may be constructed as a polyethylene material and, preferably, as a composite of high and low density polyethylene in equal concentrations thereof. This allows the tool to be cleaned with little difficultly, even when the filler material has been allowed to dry on the tool for a prolonged period of time. Of course, one of ordinary skill in this field would appreciate that the tool could also be constructed from other materials. The tool is especially configured so that it may be manipulated to work the mass of filler material into the gap to provide a professional looking seal which may have at least two different widths.

Figure 1:
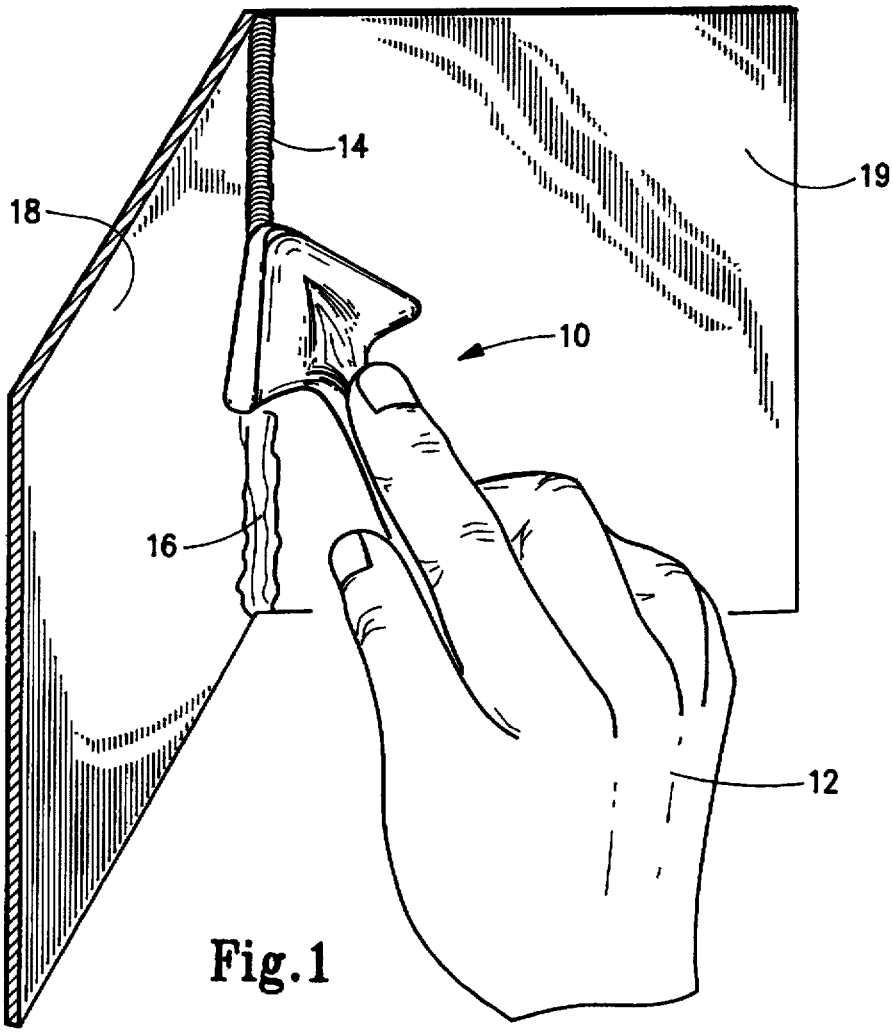
FIG. 1 is a perspective view of an applicator tool according to the exemplary embodiment of the present invention with the applicator tool being held in a user's hand and manipulated to work a mass of filler material into a joint to form a seal between two pieces.

As best shown in FIG. 1, the hand-held applicator tool 10 according to the present invention is sized to be grasped by a user's hand 12 and manipulated to work the mass of filler material 14 into a gap 16 between two structural pieces 18, 19. Here, hand-held applicator tool 10 is shown as being applied to a mass of caulking material to seal a corner joint between two tiles. Of course, it should be readily appreciated that the particular application of tool 10 should not be limited to that shown in FIG. 1 and that applicator tool 10 may be used with a variety of other sealants or filler materials to seal a joint between two structural pieces.

As shown in FIGS. 2–5, the hand-held applicator tool 10 of the present invention broadly comprises an elongated handle 30 that is adapted to be grasped by the user and a head 50 which is connected to and extends forwardly of handle 30. Handle 30 extends along a central longitudinal axis "L" and head 50 has a tapered construction so that hand-held applicator tool 10 is generally arrow-like in shape. An upper surface of tapered head 50 has a pair of lateral side edges 52 and 54 which converge in a forward direction to define a first tip 56 for tapered head 50. A first working surface 58 extends between the first pair of lateral side edges 52 and 54, and the first working surface 58 is generally concave in configuration.

Figure 4:
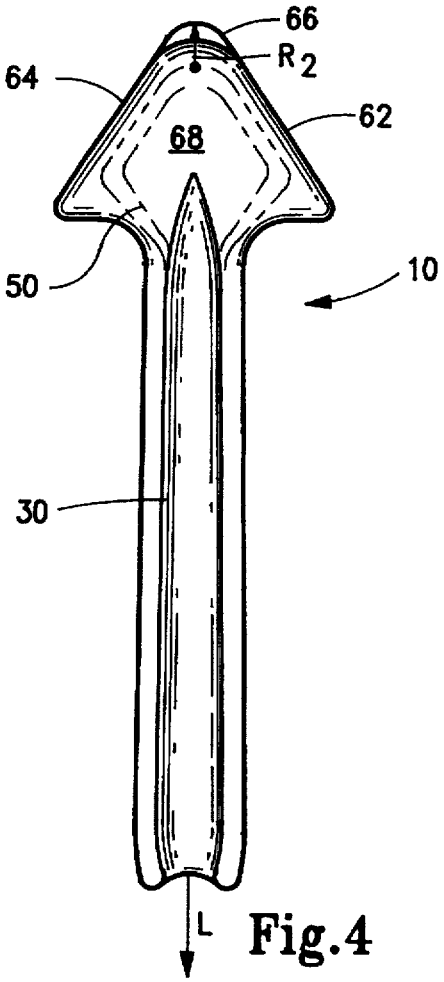
FIG. 4 is a bottom plan view of the applicator tool in FIG. 2 and showing the construction of the second working surface thereof.

As generally represented in FIG. 4, the lower side of applicator tool 10, and specifically tapered head 50, includes a second pair of lateral side edges 62 and 64 which converge forwardly of handle 30 to terminate at a second tip 66. A second working surface 68 is thereby formed between the second pair of lateral side edges 62 and 64, and this second working surface 68 also has a generally concave construction.

It is preferred that first pair of lateral side edges 52, 54 and second pair of lateral side edges 62, 64 are symmetrical about longitudinal axis "L" so that tapered head 50 is formed as an extension of handle 30. It is also preferred that first tip 56 and second tip 66 are arcuate in configuration with first tip 56 having a first selected radius of curvature $r_1$ and second tip 66 having a second selected radius of curvature $r_2$. These radii of curvature $r_1$ and $r_2$ are different so that hand-held applicator tool 10 may seal gap 16 with at least two different bead widths of the filler material 14. Preferably, these bead widths are 3/16" and 5/16", but other sizes are certainly contemplated. This is an important feature of the present invention which is not heretofore been incorporated into existing applicator tools. In the past, the application of filler materials into gaps or crevices has been limited in its application because known applicator tools have typically been designed to allow only for a single bead width finish. Unfortunately, because the area to be sealed between two structural pieces can vary from application to application, this uniform bead width is not always accommodating and the result is a finish which may not be aesthetically pleasing or functionally adequate.

Figure 2:
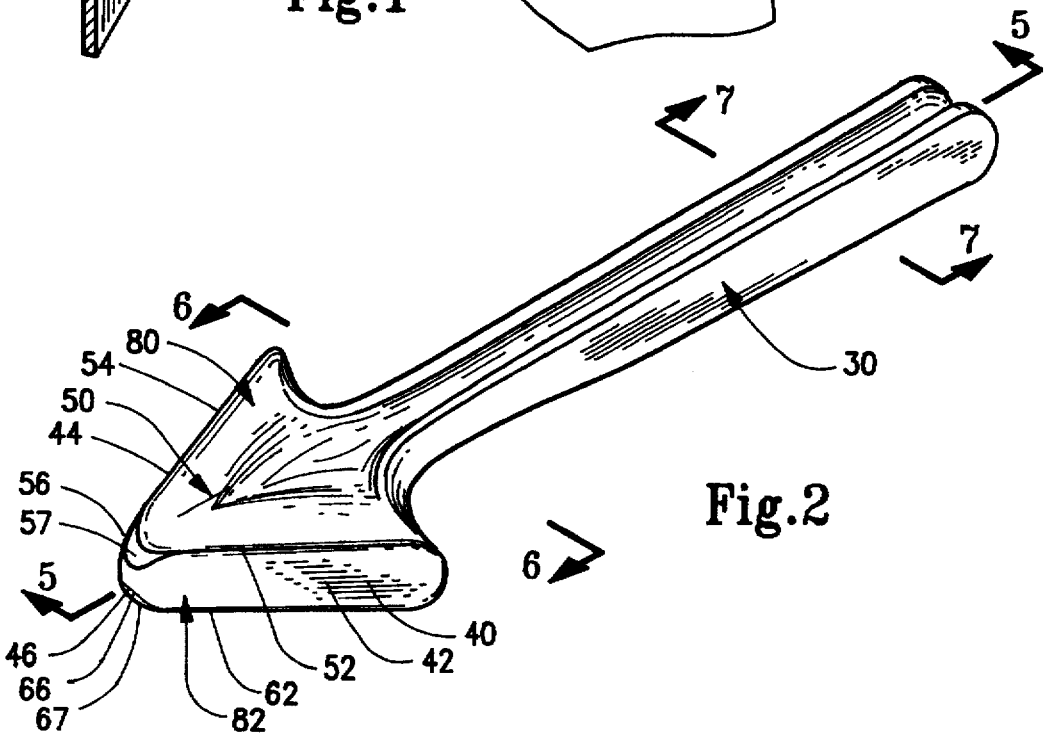
FIG. 2 is a perspective view of the applicator tool shown in FIG. 1.
Figure 3:
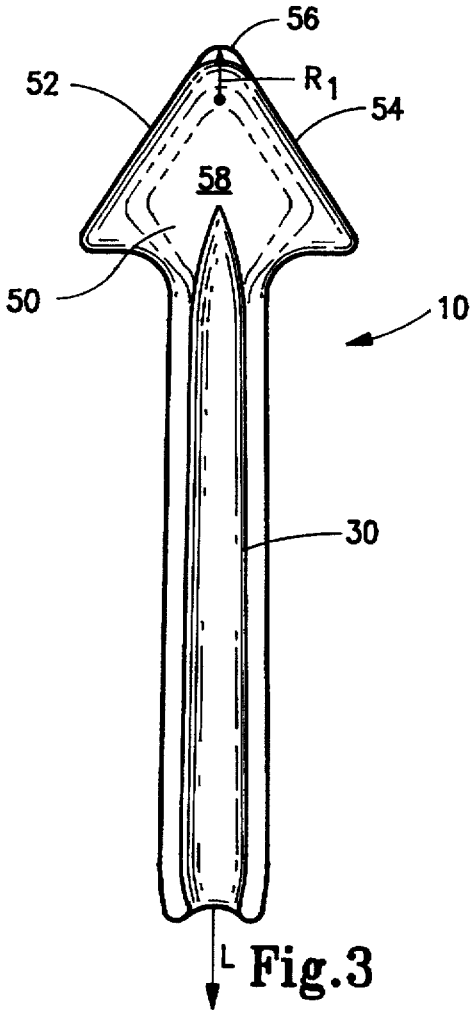
FIG. 3 is a top plan view of the applicator tool in FIG. 2 and showing the construction of the first working surface thereof.

It may also be seen in FIG. 2 that tapered head 50 includes a sidewall 40 which extends between the first pair of lateral side edges 52, 54 and the second pair of lateral side edges 62, 64. Sidewall 40 includes a left sidewall portion 42 and a right sidewall portion 44 which are oriented symmetrically about lateral sides of longitudinal axis "L" and converge forwardly of handle 30 to join at a forwardly disposed nose 46 of tapered head 50.

Figure 5:
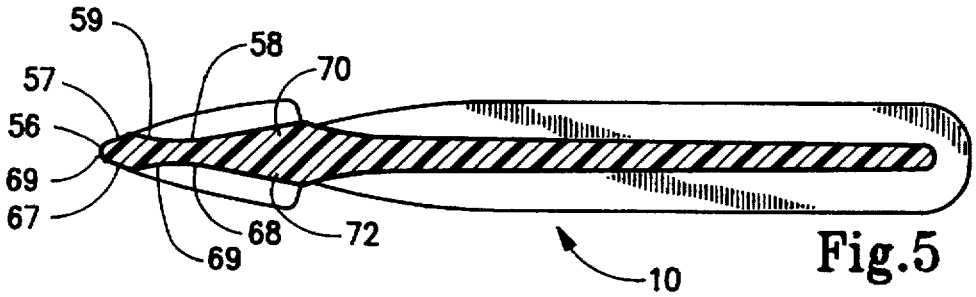
FIG. 5 is a cross-sectional view of the applicator tool about lines 5—5 in FIG. 2.
Figure 6:
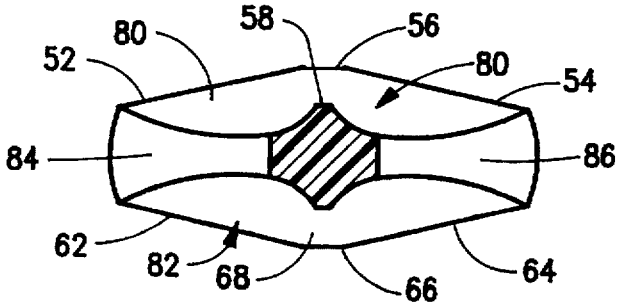
FIG. 6 is an enlarged cross-sectional view of the applicator tool about lines 6—6 in FIG. 2.

The respective contours of first working surface 58 and second working surface 68 are best shown with reference to FIG. 5 and 6 wherein it may be seen that an area 59 of first working surface 58 that is located proximate to first tip 56 is upturned, while an area 69 of second working surface 68 which is located proximate to second tip 66 is downturned. These ramped areas 59 and 69 help to avoid seepage of the filler material 14 as user 12 manipulates applicator tool in a downward direction along gap 16. As such, the filler material 14 is urged into the cavity defined by the respective working surfaces 58 and 68. As also illustrated, each of first working surface 58 and second working surface 68 may include an elevated region 70 and 72, respectively, in a region proximate to the juncture of tapered head 50 and handle 30.

Another important feature of the present invention may best be appreciated with reference to FIGS. 2 and 5 wherein a portion 57 of first working surface 58 that is located immediately adjacent to first tip 56 is flattened and sloped downwardly in the forward direction relative to upturned tip area 59. Likewise, a portion 67 of second working surface 68 that is located immediately adjacent to second tip 66 is flattened and sloped upwardly in the forward direction relative to downturned tip are 69. These features help to provide a smooth finishing touch to the filler material 14 as applicator tool 10 is used to work the filler material 14 into gap 16, as illustrated in FIG. 1. They also help to avoid unnecessary "digging" of filler material 14 during use.

In FIG. 6 it may be seen that a first rim margin 80 extends around first working surface 58 and is located adjacent to both the first pair of side edges 52, 54 and the first tip 56. Similarly, a second rim margin 82 extends around second working surface 68 and is located adjacent to both the second pair of lateral side edges 62, 64 and the second tip 66. First rim margin 80 therefore comprises regions of working surface 58 and left and right sidewall portions 42 and 44 which abut the first pair of lateral side edges 52, 54, as shown in FIG. 2. Second rim margin 82 comprises portions of second working surface 68 and left and right sidewall portions 42 and 44 which abut the second pair of lateral side edges 62, 64. First and second rim margins 80 and 82 are formed from a flexible and resilient material so that they may flex when tapered head 50 is placed at the Juncture location of the two pieces 18 and 19 and manipulated in a downward direction, as depicted in FIG. 1. This allows the tapered head 50 to conform to the contours of its environment as a selected one of working surfaces 58 and 68 is applied to the filler material 14 during application. This also permits the worked mass of material to be feathered, thereby providing a finished appearance.

In FIG. 6 it may be seen that tapered head 50 is connected to handle 30 by a pair of shoulders 84 and 86 which are, respectively, disposed on opposite lateral sides of handle 30. It is preferred that these shoulders 84 and 86 are arcuately configured and diverge from one another in the forward direction. The arcuate construction of shoulders 84 and 86 in the forward direction serves to accommodate increased flexing of tapered head 50 during use that would not otherwise be realized.

Figure 7:
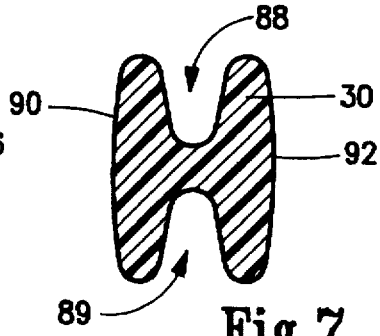
FIG. 7 is an enlarged cross-sectional view of the applicator tool about lines 7—7 in FIG. 2.

As represented in the Figures, handle 30 is preferably an elongated member to permit a user's hand 12 to effectively grasp handle 30 during use of applicator tool 10. As best illustrated in FIG. 7, handle 30 has upper and lower longitudinally extending valleys 88 and 89 so that, in cross-section, it resembles a dumbbell configuration. This construction is preferred for two reasons. First, these valleys 88 and 89 allow for tactile registration of a user's index finger therein during use, while still providing enlarged lateral side surfaces 90 and 92 on handle 30 which may be grasped. The second reason for this construction is that it is practical from a manufacturing standpoint because it reduces the production costs associated with applicator tool 10, while still providing a handle 30 which has sufficient functional strength and durability.

From the foregoing description of the exemplary embodiment of the hand-held applicator tool according to the present invention, it should be appreciated that use of the applicator tool is fairly straightforward. In order to properly seal a gap or crevice between two structural pieces, a mass of filler material is applied along the gap as either a continuous stream or in discrete amounts therealong.

Depending upon the size of the gap to be sealed or the user's own preference, a desired bead width for the seal is selected which determines which one of the first and second working surfaces is to be applied to work the filler material. The user then grasps the applicator tool and orients the tool so that the selected working surface is placed in contact with the filler material. Pressure is exerted on the handle so that the lateral side edges of the working surface flex to conform to the contours of the structural pieces proximate to the gap. As the user manipulates the applicator tool in a downward direction along the gap, a uniform bead of filler material is worked into the gap to form the seal and excess filler material is captured within the cavity of the working surface. If performed correctly, the process does not need to be repeated and any excess filler material or the applicator tool may simply be wiped off.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A hand held applicator tool adapted to work a mass of filler material into a gap to form a seal between two pieces, comprising:

(a) a handle having a longitudinal axis and adapted to be held by a user; and (b) a tapered head connected to and extending forwardly of said handle, said tapered head having upper lateral side edges which converge in a forward direction to define a tip for said tapered head and having a working surface that extends between said lateral side edges with said working surface having an upturned tip area located proximate to said tip, said tapered head including a rim margin that is adjacent to both said lateral side edges and said tip, said rim margin being formed of a flexible, resilient material so that said rim margin may flex when the user grasps said handle and manipulates said tapered head, thereby working the mass of filler material into the gap to form said seal.

2. A hand held applicator tool according to claim 1 wherein said tip area is curved and has a selected radius of curvature.

3. A hand claim 1 applicator tool according to claim 1 wherein said material is a composite of high density polyethylene and low density polyethylene.

4. A hand held applicator tool according to claim 1 wherein said head is enlarged proximate to said handle in a direction transverse to the longitudinal axis and wherein said lateral side edges are symmetrical about said longitudinal axis.

5. A hand held applicator tool according to claim 4 wherein said head is connected to said handle by a pair of shoulders which diverge forwardly of said handle to intersect, respectively, said lateral side edges.

6. A hand held applicator tool according to claim 5 wherein said shoulders are symmetrical about said longitudinal axis and are arcuately configured to accommodate increased flexing of said rim margin during use.

7. A hand held applicator tool according to claim 1 wherein said applicator tool is molded as an integral, one-piece construction of plastic material.

8. A hand held applicator tool according to claim 1 wherein said working surface includes an elevated region proximate to said handle.

9. A hand held applicator tool according to claim 1 wherein a portion of said working surface immediately adjacent to said tip is flattened.

10. A hand held applicator tool according to claim 9 wherein said portion is sloped downwardly in the forward direction relative to said upturned tip area.

11. A hand held applicator tool adapted to work a mass of filler material into a gap to form a seal between two pieces, comprising:

(a) a handle having a longitudinal axis and adapted to be held by a user; and (b) a tapered head connected to and extending forwardly of said handle, said tapered head having a first pair of lateral side edges which converge in a forward direction to define a first tip for said tapered head and a second pair of lateral side edges which converge in the forward direction to define a second tip for said tapered head, said tapered head having a first working surface extending between said first pair of lateral side edges and a second working surface extending between said second pair of lateral side edges, with each of said first and second working surfaces being ramped in an area located proximate to their respective said tips, said tapered head further including a first rim margin located adjacent to both said first pair of lateral side edges and said first tip and a second rim margin located adjacent to both said second pair of lateral side edges and said second tip, with said first and second rim margins formed of a flexible, resilient material so that when the user grasps said handle and manipulates said tapered head, thereby to act on said mass of filler material with a selected one of said first and second working surfaces, an associated one of said rim margins flexes so that said filler material is worked into the gap to form said seal.

12. A hand held applicator tool according to claim 11 wherein said first working surface defines an upper surface of said tapered head and said second working surface defines a lower surface of said tapered head.

13. A hand held applicator tool according to claim 12 wherein each of said first and second working surfaces includes an elevated region located proximate to said handle.

14. A hand held applicator tool according to claim 11 wherein said tapered head includes a sidewall which extends between said first and second pairs of lateral side edges.

15. A hand held applicator tool according to claim 11 wherein said first tip is curved and has a first radius of curvature and wherein said second tip is curved and has a second radius of curvature.

16. A hand held applicator tool according to claim 15 wherein said first radius of curvature is greater than said second radius of curvature so that said applicator tool may be manipulated to seal between the pieces with two different bead widths of said filler material.

17. A hand held applicator tool according to claim 11 wherein said head is enlarged proximate to said handle in a direction transverse to the longitudinal axis and wherein said first and second pairs of lateral side edges are symmetrical about said longitudinal axis.

18. A hand held applicator tool according to claim 11 wherein said head is connected to said handle by a pair of shoulders which diverge forwardly of said handle.

19. A hand held applicator tool according to claim 18 wherein said shoulders are symmetrical about said longitudinal axis and are arcuately configured to accommodate increased flexing of said first and second rim margins during use.

20. A hand held applicator tool according to claim 11 wherein said applicator tool is molded as an integral, one-piece construction from a stiff, yet resilient material.

* * * * *